United States Patent [19]

Weidenaar et al.

[11] 4,003,416

[45] Jan. 18, 1977

[54] LIQUID-DISPENSING NOZZLE ASSEMBLY

[75] Inventors: Bernard E. Weidenaar, Hacienda Heights, Calif.; Frederick L. Voelz, Orland Park; James J. Simnick, Riverdale, both of Ill.; Peter P. Moskovich, Jr., Gary, Ind.

[73] Assignee: Atlantic Richfield Company, Philadelphia, Pa.

[22] Filed: Mar. 31, 1975

[21] Appl. No.: 563,879

Related U.S. Application Data

[63] Continuation-in-part of Ser. No. 468,787, May 9, 1974, abandoned.

[52] U.S. Cl. ..... 141/392

[51] Int. Cl.[2] ..... B65B 3/04

[58] Field of Search ..... 141/DIG. 1, 44, 52, 141/39–43, 59, 97, 290, 310, 382–384, 387, 388, 390, 392; 285/263, 272; 260/2 SF

[56] References Cited

UNITED STATES PATENTS 3,840,055 10/1974 Wostl et al. ..... 141/392

*Primary Examiner*—Houston S. Bell, Jr.
*Attorney, Agent, or Firm*—Thomas J. Clough

[57] ABSTRACT

An improved liquid-dispensing nozzle and more specifically, an improved vapor recovery means for a nozzle comprising a vapor collector (such as a flexible bellows) surrounding a portion of the discharge spout in spaced relation thereto, one end of which is sealed to the upper portion of the spout; and at the other end of the vapor collector, a compressible cellular plastic material such as foamed plastic associated therewith. When the discharge spout is inserted into, e.g., an automobile fillpipe, the compressible cellular plastic material forms a vapor seal with the upper end of the fillpipe whereby the vapors escaping from the fillpipe are directed into the interior chamber formed between the exterior of the discharge spout and the inside of the vapor collector thereby minimizing the escape of vapors to the atmosphere. The vapors are then removed from this chamber. The compressible cellular plastic material is made from a fluorine containing elastomer.

13 Claims, 2 Drawing Figures

LIQUID-DISPENSING NOZZLE ASSEMBLY

This application is a continuation-in-part of Ser. No. 468,787, filed May 9, 1974, now abandoned.

The present invention relates to a nozzle for dispensing a liquid, and more particularly to a nozzle having means for preventing the escape of vapors during a liquid dispensing operation.

Normally, as a fuel such as gasoline is being supplied through a fuel-dispensing nozzle to, for example, an automobile fuel tank, fuel vapor escapes from the fuel tank fillpipe, this vapor of course adding to the already pressing air pollution problem. Such air pollution is increasingly becoming a cause of concern and numerous governmental jurisdictions are requiring control of causes of air pollution. An increasing number of jurisdictions are requiring minimization of escape of both liquid fuel and fuel vapor from vehicles which are being supplied with fuel. Reducing the fuel delivery rate, while reducing liquid-splash-back, does not prevent escape of vapors and in fact, because of the longer time required to fill the vehicle fuel tank, may increase the escape of fuel vapors lost during the filling of the tank.

The prior art has suggested various means of recovering vapors which otherwise would escape to the atmosphere while fuel tanks are being filled. For example, U.S. Pat. No. 3,581,782 discloses a vapor emission control system suitable for gasoline and other fuel delivery systems, and adapted to eliminate the escape of fuel vapors to the atmosphere. The disclosed embodiment of the control system includes, for example, a flexible annular sleeve surrounding the spout of the nozzle and sealed to the fillpipe of the fuel tank by means of an expandible member which, when expanded after the spout is inserted into the fillpipe, prevents the emission of vapor to the atmosphere.

Similarly, U.S. Pat. No. 3,566,928 discloses a vapor seal for fuel dispensing nozzles wherein the forward end (i.e., the end opposite the main housing of the nozzle) of the flexible bellows which surrounds the spout is sealed to the fillpipe by means of an annular-shaped magnetic rubber sealing assembly.

It is known also in the prior art simply to employ a flexible means surrounding the spout, such as the flexible bellows by itself. In this case, when the discharge spout is inserted into the fillpipe, the flexible bellows is compressed and tends to seal itself to the upper portion of the fillpipe. However, this seal between the forward or heel portion of the bellows and the upper portion of the fillpipe is not a good one, and hence the above-noted prior art suggestion for using magnetic rubber means.

Reference is also made to U.S. Pat. Nos. 2,850,049 and 2,908,299 for fuel vapor recovery systems.

There is therefore a need for a simple and effective device for sealing a vapor collection device to the upper portion of, for example, an automobile fillpipe. Specifically, there is a need for improving the seal that is possible between, for example, the flexible bellows of the prior art and the upper portion of an automobile fuel tank fillpipe.

It is therefore a primary object of the present invention to provide a liquid-dispensing nozzle provided with vapor recovery means.

It is a further object of the present invention to provide a liquid fuel-dispensing nozzle wherein the seal between the vapor collecting means and the automobile fuel tank fillpipe is improved.

It is yet a further object of the present invention to provide such an improved sealing means which is simple in design.

Other objects and advantages will become apparent to those skilled in the art from the ensuing description.

The present invention accomplishes the above objects and others by utilizing, in conjunction with a vapor collector means (such as flexible bellows) which surround a portion of the discharge spout of a liquid fuel-dispensing nozzle, a compressible cellular plastic material such as foamed plastic mounted on the forward or heel portion thereof to engage the upper portion of, for example, the automobile fuel tank fillpipe. The use of the compressible cellular plastic material provides a greatly improved seal between the vapor collector means, preferably a flexible bellows, and the fillpipe compared to the use of the vapor collector alone. A preferred material is made from fluorine containing elastomers.

The improved vapor recovery apparatus of the present invention is particularly useful with conventional liquid-fuel-dispensing nozzles, and while the present invention is applicable to all liquid-dispensing nozzles, it is particularly useful with liquid fuel (e.g., gasoline) nozzles, and the present invention will therefore be described with reference to the latter, although those skilled in the art will realize that the invention generally is applicable to a much broader field.

A liquid fuel-dispensing nozzle comprises a main body or housing having an integral handle, a fuel inlet which normally comprises a flexible conduit means communicating between the source of fuel such as an underground storage tank, and a discharge spout which is adapted for insertion into the fillpipe of the fuel tank. A spring means is usually provided around a major portion of the discharge spout. The spring means assists in holding the spout in the fillpipe during the filling operation, especially during self-serve operations.

As pointed out above, the prior art has suggested that a vapor collecting device, such as a flexible bellows, be employed to surround a major portion of the discharge spout. The bellows is sealed to the housing at the upper end of the spout and terminates in a heel-portion which is annular in shape and has a flat face for contacting the upper portion of the fillpipe. As the spout is inserted into the fillpipe, the bellows is compressed and the flat face of the heel portion forms a seal with the upper portion of the fillpipe.

According to the present invention, a compressible cellular plastic material, such as a foamed synthetic resin cellular plastic, is carried by or secured to the flat-faced heel portion of the bellows and it is the compressible cellular plastic material which contains the fillpipe. It has been found that such material greatly improves the seal between the flexible bellows and the fillpipe and improves the reduction in the amount of vapors escaping to the atmosphere. Suitable means is provided for removing the vapors from the interior of the bellows, as is conventional.

Figure 1:
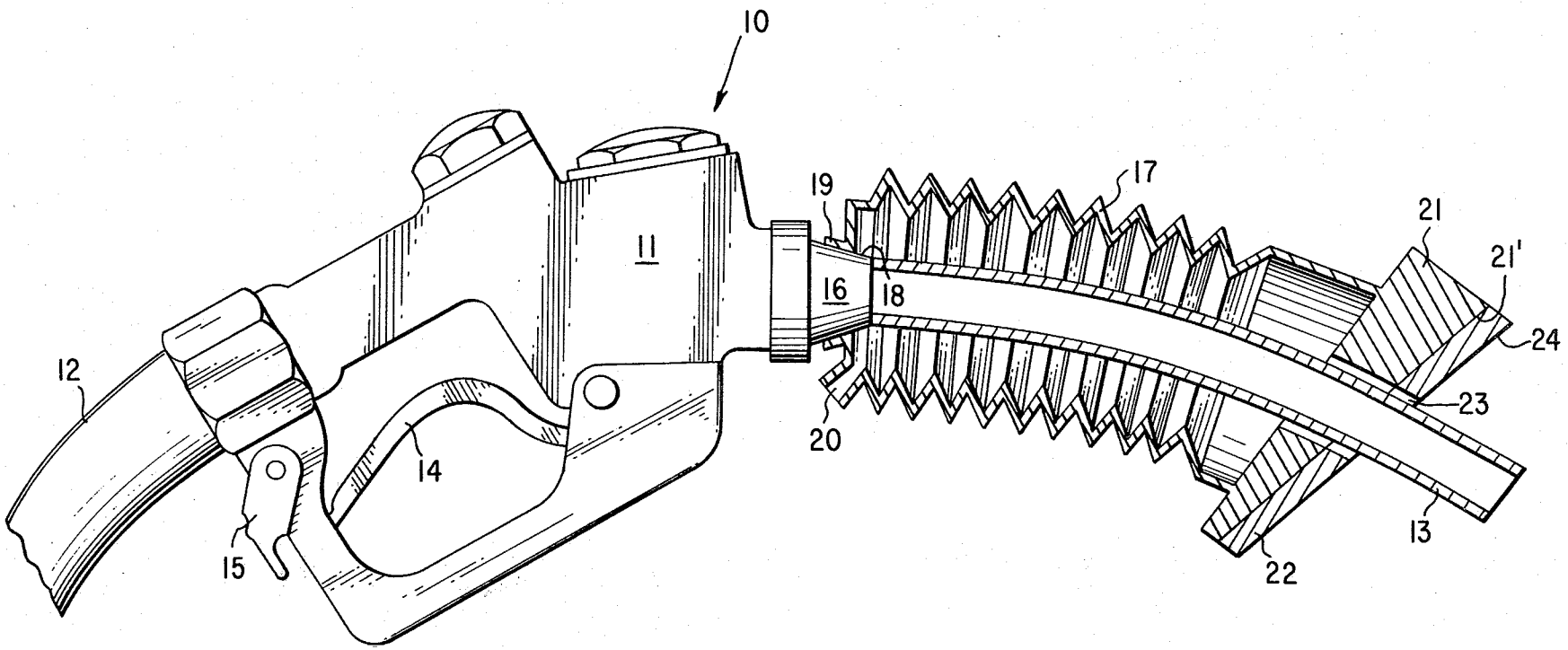
FIG. 1 is a side view, partly in cross-section, of the improved fuel-dispensing nozzle of the present invention.

Referring now to FIG. 1, a typical gasoline-dispensing nozzle is shown which is provided with vapor recovery means. More specifically, a nozzle generally designated 10 comprises a main body or housing 11, an inlet conduit 12 and a discharge spout 13. A handle 14 is provided for actuating the delivery of gasoline or other liquid fuel. In addition, and as in conventional, a retainer means 15 is also provided on the main body of the housing for holding the handle 14 in its fuel-delivery position. It is also conventional to provide such nozzles with means for automatically shutting off delivery of fuel when the fuel tank or fillpipe is full. Such means are not shown in FIG. 1, but may include an orifice near the discharge outlet of the spout 13, and a tube communicating from the orifice to a control mechanism within the main body 11 of the nozzle, wherein the control mechanism, sensing the presence of a gas or liquid near the orifice, acts to disengage handle 14 from retainer 15 thereby automatically stopping delivery of fuel through the nozzle.

The major portion of spout 13 is surrounded by a flexible vapor collector which may take the form of a flexible bellows 17. The upper end 19 of bellows 17 is sealed to surface 18 of tapered portion 16 of the nozzle. The opposite end of bellows 17 comprises a heel portion 21 having a flat face 21′ and, according to the present invention, a compressible cellular plastic material 22 is carried by or secured to face 21′ of heel portion 21. Both heel portion 21 and compressible cellular plastic material 22 are substantially annular in shape providing a space 23 between the same and the outside surface of spout 13, allowing vapors escaping from the fillpipe to pass therebetween and into the interior of bellows 17. An aperture 20 is conveniently provided near the upper end of the bellows 17 for removal of vapors. The means for removing the vapors from aperture 20 is not per se included within the scope of the present invention, but may comprise, for example, a flexible tubing attached to aperture 20, the flexible tubing communicating with, for example, a combustion means whereby the vapors may be rendered harmless. Alternatively, the hydrocarbons in the vapors may be recovered by other suitable means such as by adsorpotion or condensation.

Figure 2:
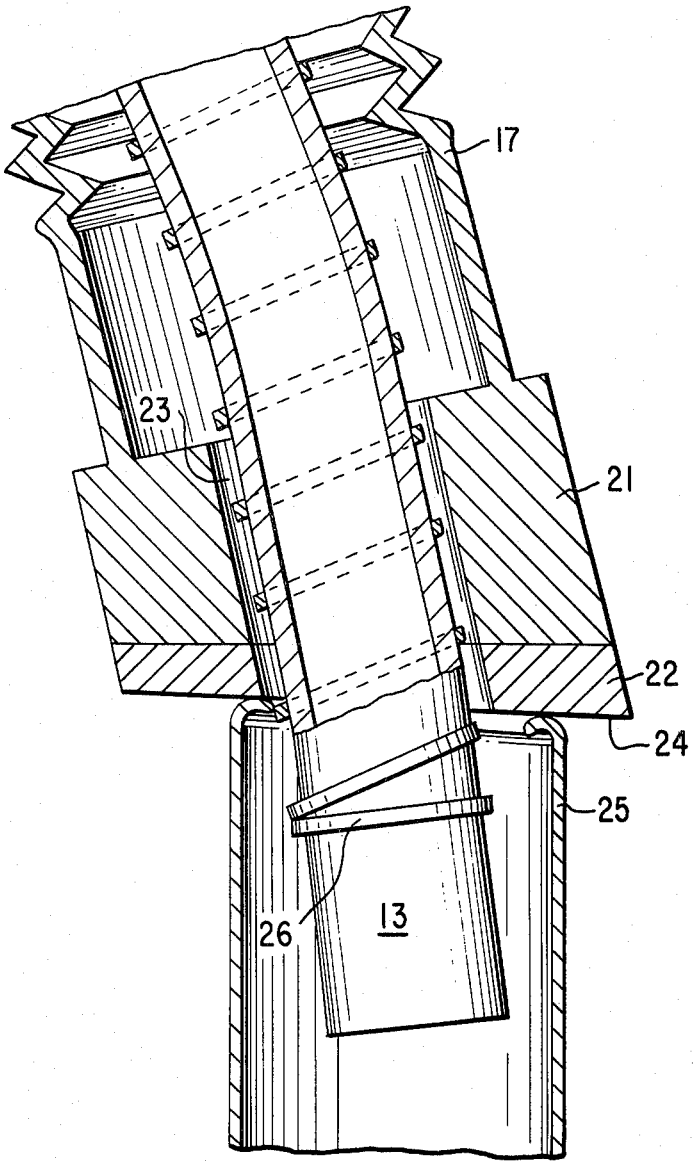
FIG. 2 is an enlarged view, partly in cross-section, of the improved liquid fuel-dispensing nozzle of the present invention inserted into a fillpipe of an automobile fuel tank.

Face 24 of compressible cellular plastic material 22 is the surface which contacts the fillpipe, reference now being made to FIG. 2 which shows the nozzle of the present invention inserted into a fillpipe. More specifically, referring to FIG. 2, spout 13 is shown inserted into a fillpipe 25, the upper portion of the latter contacting face 24 of compressible cellular plastic material 22 thereby sealing the same against vapor escape. The spout 13 is shown as being provided with a spring means 26 which assists in maintaining the spout in the fillpipe during the filling operation. The spring 26 is preferably of square cross-section although a round spring is satisfactory. In operation, as the spout is inserted into the fillpipe, the spring means acts to ratain the same therein. As the spout 13 is forced into the fillpipe, the bellow 17 is compressed and as the spout is held therein by means of the spring 26, face 24 of compressible cellular plastic material 22 tightly seals the fillpipe against possible vapor loss. Vapors which leave fillpipe 25 pass through space 23 into the interior of bellows 17 from which they are removed through aperture 20 (see FIG. 1).

The compressible cellular plastic material may be secured to the heel portion 21 of the bellows by any suitable means, for example, an epoxy-type cement can be employed for this purpose, but those skilled in the art will realize that any adhesive means may be employed for this purpose. Of course, the flexible bellows and compressible cellular plastic material must be formed of materials which are substantially resistant to the fuel liquid and vapor being dispensed. For example, the bellows may be comprised of a flexible polychloroprene rubber (i.e., neoprene), such bellows being commercially available. The compressible cellular plastic is defined as a cellular plastic material which is compressible under a normal load (in psi.) obtained when the compressible cellular plastic contacts the fillpipe during the dispensing of fuel. The term "compressible" is used in its normal dictionary sense and includes materials which deform to a certain extent when the spout of the nozzle is inserted into the fillpipe, thereby providing an extremely good seal against vapor escape. Typically, the compressible cellular plastic material is compressed under such normal load in the range of from about 5 to about 85%, more preferably from about 25 to about 70% based upon the original volume of material. As stated above, such compressible cellular plastic material should be substantially resistant towards the fuel liquid being dispensed and the corresponding vapor, particularly when such fuel is gasoline.

It has been found that a particularly preferred compressible cellular plastic material having improved resistance to abrasion and the ability to conform to a fillpipe is obtained from a fluorine containing elastomer. The fluorine containing elastomers which can be used for forming the compressible cellular material are those elastomers which comprise at least about 10 weight percent of fluorine. The fluorine is more preferably present in the elastomers in a weight percent of at least about 35 and still more preferably at least about 60. In a still more preferred embodiment of this invention, the fluorine containing elastomers are derived from vinylidene fluoride preferably within the weight percentage ranges as set forth above.

The fluorine containing elastomers utilized in forming the compressible cellular material are vulcanized and/or cured and the cellular structure formed using materials and process conditions which are typical for fluorine containing elastomers. The materials and conditions utilized are chosen in order to provide a compressible cellular material which has performance characteristics as set forth herein.

It will be understood for the purposes of this specification that the term fluorine containing elastomers is used in a generic sense to include homopolymers, copolymers, terpolymers and other interpolymers which have molecular weights of at least about 50,000, more preferably from about 100,000 to about 3,000,000. The various copolymerizable monomers as set forth below can vary widely but should not materially deteriorate the fluorine containing cellular material in hydrocarbon resistance, abrasion resistance and performance characteristics as set forth herein.

The fluorine containing monomer is usually polymerized by free radical polyermization technique (also know as the addition polymerization technique) although other techniques may be used. Such technique consists of contacting the monomer(s) with polymerization initiator either in the absence or presence of a diluent at a temperature usually between 0° and 200° C. The polymerization initiator is a substance capable of liberating a free radical under the conditions of polymerization, e.g., benzoyl peroxide, tert-butyl hydroperoxide, cumyl peroxide, postassium persulfate, acetyl peroxide, hydrogen peroxide, axobisisobutyronitrile, or perbenzoic acid. Ammonium persulfate is commonly used.

The fluorine containing monomer may also be polymerized or copolymerized using an anionic initiator such as naphtylsodium or butyllithium in tetrahydrofuran solution or sodium metal in liquid ammonia solution.

The polymerization of the fluorine containing monomer may also be effected by other polymerization techniques such as by the use of Ziegler type catalysts, gamma ray irradiation, or thermal techniques.

The diluent for the polymerization mixture may be either an inert solvent such as benzene, toluene, xylene, cyclohexane, hexane, naphtha, tetrahydrofuran, white oil, or dodecane; or a non-solvent such as water or liquid ammonia. Thus, the polymerization can be carried out in bulk, solution, emulsion, or suspension.

The temperature for the polymerization depends on the catalyst system employed and to some extent upon the nature of th monomers to be polymerized. Thus, the copolymerization of an fluorine containing monomer with a very reactive compound may be catalyzed at temperatures from about −100° to 50° C., preferably at −70° to 0° C. On the other hand, the optimum temperature for effecting the free radical catalyzed homopolymerization of an fluorine containing monomer is usually from 0° to 140° C., preferably 80° to 125° C. Similarly, the optimum temperatures for effecting the free radical catalyzed interpolymerization of for example vinylidene fluoride with one or more polymerizable comonomers will vary according to the reactivity of these other comonomers. In most instances such temperatures likewise are within the range from about 0° to 150° C.

A large variety of comonomers can be used to form polymers with one or more fluorine containing monomers. For the most part, such monomers are polymerizable vinyl monomers and there partially or completely fluoronated counterparts (i.e., substituting fluorine for hydrogen). They include, for example: (1) esters of unsaturated alcohols. (2) esters of unsaturated acids, (3) vinyl cyclic compounds, (4) unsaturated ethers, (5) unsaturated ketones, (6) unsaturated amides, (7) unsaturated aliphatic hydrocarbons, (8) vinyl halides, (9) esters of unsaturated polyhdric alcohols (e.g., butenediol), (10) unsaturated acids, (11) unsaturated acid anhydrides, (12) unsaturated acid chlorides, and (13) unsaturated nitriles.

Specific illustrations of such components are:

1. Esters of unsaturated alcohols, i.e., allyl, methallyl crotyl, 1-chloroallyl, 2-chloroallyl cinnamyl, vinyl, methyl-vinyl, 1-phenallyl, butenyl, etc., and (a) saturated acids such as for instance, acetic, propionic, buyric, valeric, caproic, stearic, etc.; (b) unsaturated acids such as acrylic alpha-substituted acrylic (including alkacrylic, e.g., methacrylic, ethylacrylic, propylacrylic, etc.), crontonic, oleic, linoleic, linolenic, etc., (c) polybasic acids such as oxalic, malonic, succinic, glutaric, adipic, pimelic, suberic, axelaic, sebcic, etc., (d) unsaturated polybasis acids such as maleic, furmaric, citraconic, mesaconic, itaconic, methylenemalonic, acetylene-dicarbonzylic aconitic, etc., (e) aromatic acids, e.g., benzoic, phenylacetic, phthalic, terephthalic, benzolyphthalic, etc.

2. The esters of saturated alcohols such as methyl, ethyl, propyl, isopropyl, butyl, isobutyl, sec-butyl, tert-butyl, 2-ethylhexyl, cyclohexyl, benzyl, etc., with unsaturated aliphatic monobasic and polybasic acids, examples of which are illustrated above.

3. Esters of unsaturated polyhydric alcohols, e.g., butenediol, etc., with saturated and unsaturated aliphatic and aromatic, monobasic and polybasic acids, illustrative examples of which appear above.

4. Vinyl cyclic compounds including (a) monovinyl aromatic hydrocarbons, e.g., styrene, o-, m-, p-chlorostyrenes, -bromostyrenes, -fluorostyrene, -methylstyrenes, -ethylstyrenes, -cyanostyrenes, do-, tri- and tetra-, etc., -chlorostyrenes, -bromostyrenes, -fluorostyrenes, -methylstyrenes, -ethylstyrenes, -cyanostyrenes, vinylcyclohexane, vinylfuran, vinylpyridine, vinylbenzofuran, divinybenzene, trivinylbenzene, allybenzene, N-vinylcarbazole, N-vinylpyrrolidone, N-vinyloxazolidone, etc.

5. Unsaturated ethers such as, e.g., methyl vinyl ether, ethyl vinyl ether, cyclohexyl vinyl ether; octyl vinyl ether, diallylether, allyl ethyl ether, etc.

6. Unsaturated ketones, e.g., methyl vinyl ketone, ethyl vinyl ketone, etc.

7. Unsaturated amides, such as acrylamide, N-methylacrylamide, N-phenylacrylamide, N-allylacrylamide, N-methylolacrylamide, N-allycaprolactam, etc.

8. Unsaturated aliphatic hydrocarbons, for instance, ethylene, propylene, butenes, butadiene, isoprene, 2-chlorobutadiene, alpha-olefins, etc.

9. Vinyl halides, e.g., vinyl fluorice, vinyl chloride, vinyl bromide, binyl iodine, vinylidene chloride, vinylidene bromide, allyl chloride, allyl bromide, etc.

10. Unsaturated acid anhdrides, e.g., maleic, citraconic, propylacrylic, etc., examples of which appear above.

11. Unsaturated acid anhydrides, e.g., maleic, citraconic, itaconic, cis-4-cyclohexene-1, 2-dicarbonxylic, bicyclo (2.2.1) 5-heptene-2, 3-dicarboxylic, etc.

12. Unsaturated acid halides such as cinnamoyl, acrylyl, methacrylyl, crontonyl, oleyl, fumaryl, etc.

13. Unsaturated nitriles, e.g., acrylonitrile, methacrylonitirle and other substituted acrylonitriles.

Some particular types of this elastomer are copolymers of vinylidene fluoride with chlorotrifuloroethylene, and/or hexafluoropropylene, and a tipolymer of vinylidine fluoride, hexafluoropropylene, and tetrafluoroethylene. Other suitable types are an elastomeric copolymer of vinylidine fluoride and 1-hydropentafluoropropylen and a tripolymer of these monomers and tetrafluoroethylene.

Elastomers are based on vinylidene fluoride have been prepared in most cases by radical polymerization in emulsion by the use of organic or inorganic peroxy compounds, such as ammonium persulfate, as an initiator. A fluourinated carboxylic acid soap may be used but is not required. Useful temperature and pressure ranges are 80° to 125° C and 300 to 1500 psig, respectively. Molecular weight is controlled by the monomer-/initiator ratio or by the use of certain chain transfer agents such as carbon tetrachlorie, chloroform, alkyl mercaptans, alkyl esters, and iodine, bromine, chlorine, or selected halogen salts.

Low molecular weight fluid or semifluid polymers suitable for use as caulk bases and processing aids for fluorocarbon rubbers can be used. Polymerization of vinylidene fluoride and hexafluoropropylene in the presence of certain chain transfer agents such as aliphatic alcohols, ketones, and esters produces viscous oils and semi-solids which can be cured with diamines. Another approach produces useable polymerica dicarboxylic acids by dehydrofluorinating a high molecular weight vinylidene fluoride/hexafluoropropylene copolymer or vinylidene fluoride/hexafluoropropylene/-tetrafluoroethylene tripolymer with an amine or other base, and oxidizing the resulting unsaturated polymer with potassium permanganate in acetone or glacial acetic acid or with fuming nitric acid. Carboxyl or carbalkoxyl terminated vinylidene fluoride/hexafluoropropylene dipolymers have also been made by the use of special initiators and are suitable. For example:

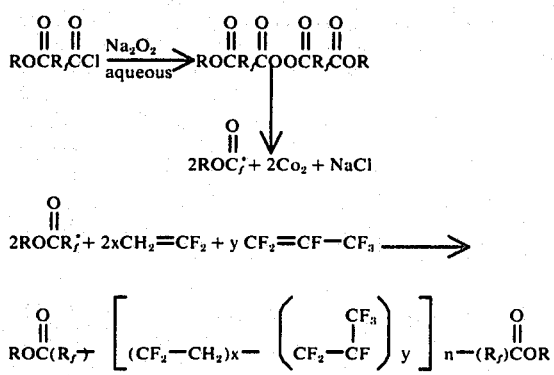

These polymers can be cured with metal oxides, epoxides, or azirane derivatives.

Another type of fluorine containing elastomers suitable are fluorosilicone elastomers. Fluoralkylsiloxanes or other suitable high molecular weight polymers from which solvent resistant elastomers having good low and high temperature flexibility can be used.

The fluorosilicone elastomers can be made by ionic polymerization processes. One preparation of basic monomer and elastomer is shown below:

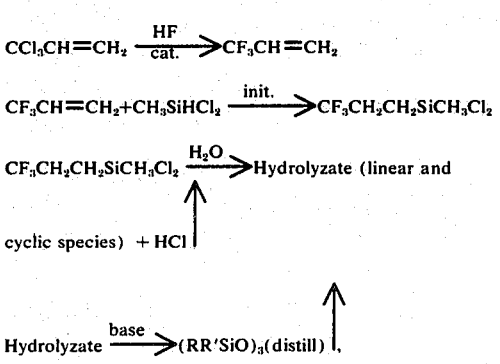

where $R = CH_3—$, and $R' = CH_3CH_2CH_2—$. The cyclic trimer is purified by distillation and then converted to polymer at elevated temperature in the presence of a basic catalyst. The polymer is in equilibrium with cyclic trimer and cyclic tetramer and the system greatly favors the cyclic tetramer. Hence, the polymerization must be stopped before equilibrium is reached and careful control of reaction temperature and time is essential. In commercial practice, gum polymers of a degree of polymerization of about 6000 are obtained. A small number of vinyl substituents can be introduced into the polymer by means a comonomer in order to facilitate peroxidic curing.

The amount of fluorine which can be introduced into a fluorosilicone rubber is limited somewhat by the tendency of $\alpha$- or $\beta$-fluoroalkyl substitutents on silicone to undergo hydrolytic or thermal cleavage.

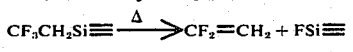

Thus, the preference for the $\gamma$-fluorinated substitutent. Despite this limitation, polymers with very good resistance to aliphatic and aromatic hydrocarbon fluids are obtained. The solubility parameter for a methyl, 3,3,3,-trifluoropropylsilicone polymer is 9.6 similar to the value for a typical fluorocarbon elastomer and substantially different from that of a dimethylsilicone polymer, which is about 7.5. Methyl, 3,3,3-trifluoropropylsilicone rubber is amorphous, has a density of 1.25 g. $cm^{-3}$ at 25° C, and a glass transition temperature of −65° C.

Both one-part and two-part room-temperature-vulcanizing fluorosilicone elastomers can also be used.

Other suitable fluoronated elastomers are
perfluoro (alkyl vinyl ether) copolymers,
tetrafluoroethylene/perfluoronitrosomethane elastomers, and
perfluoroalkylene triazine elastomers.

As stated above the formation of the cellular structure and the vulcanization and/or curing are adjusted in order to prepare a cellular material having the compressibility and physical characteristics as set forth herein. For methods of preparing the cellular structure see the following references which are herein incorporated by reference: H. J. Stern, *Rubber: Natural and Synthetic*, second. Ed., Palmerton Publishing Co., N.Y., 1967, pp. 360–365; *The Vanderbilt Rubber Handbook*, R. T. Vanderbilt Co., Inc., N.Y., 1958, ppg, 463–4, 478–9, 486; and W. J. S. Naunton, Ed., *The Applied Science of Rubber* Edward Arnold (Publishers) Ltd. London, 1961. While either an open cell or closed cell structure is suitable, a predominantly closed cell structure is preferred.

The exposed face of the compressible cellular plastic material can be coated with the same plastic material used to form the cellular plastic material. Thus, the face can have a surface skin or coating which contacts the receiver inlet to which liquid is being dispensed. In addition, the face of the compressible cellular plastic material can have a surface skin or coating which is of a different material such as a synthetic resinous material or a natural occurring material, both of which are substantially resistant to fuel liquid and vapor being dispensed. The coating material, either the same or different from the compressible cellular plastic material, has to be resilient, that is, the material deforms to a certain extent when the spout of the nozzle is inserted into the fuel pipe. Typical examples of resilient material are leather and synthetic resin such as polychloroprene (neoprene). It is contemplated within the scope of this invention that the term "compressible cellular plasic material" obtained from a fluorine containing elastomer includes such coating or different resilient material affixed thereto to form the exposed face seal.

The thickness of the compressible cellular plastic material is not critical, and may vary from a minimum thickness required to provide the minimum seal to a maximum thickness which would be dictated by economic considerations (i.e., an extremely thick material would not be required). Typically, the compressible cellular plastic material is utilized in a thickness which may range from about 1/16 inch to about ½ inch.

The invention can be better appreciated by the following non-limiting examples:

EXAMPLE I

An OPW No. 7 vapor recovery gasoline dispensing nozzle is equipped with a polychloroprene bellows boot, one end of which is attached to the nozzle housing, the other end surrounding the nozzle outlet having only an exposed plain surface. The bellows boot is substantially of the same geometrical configuration as the boot set forth in FIG. I. The nozzle has equipped a face comprising a closed cell fluorine containing foam of approximately ¼ inch thickness. The sealing wear and abrasion resistance utilizing the nozzle with the foam face provides for an improved nozzle.

EXAMPLE II

A modified OPW No. 7 vapor recovery nozzle is equipped with a polychloroprene bellows boot one end of which is attached to the nozzle housing, the other end surrounding the nozzle outlet having a surface face. The nozzle is made to include a ¾ inch vapor return line on the bottom of the handle area. A square cross-section reaction latch is used on the spout. The bellows boot is substantially the same geometrical configuration as the boot set forth in FIG. I. The surface of a first boot is modified by affixing a unidirectional magnet to the boot surface. The magnet is further modified by the bonding of a fluorine containing elastomer foam having a thickness of ⅛ inch to the unidirectional magnet.

Again hydrocarbon recovery is improved with the nozzle having the fluorine containing elastomer foam.

The previous examples demonstrates the outstanding recovery of hydrocarbon vapor using the improved vapor recovery apparatus of this invention. More particularly, the Examples I and II demonstrate the contribution of the compressible cellular plastic material in substantially preventing the escape of hydrocarbon vapor during the dispensing of fuel to a motor vehicle. The increase in percent recovery with the compressible cellular plastic material is particularly relevant where high hydrocarbon recoveries are required due to environmental regulations.

The improved vapor sealing means of the present invention can be employed with any liquid-dispensing nozzle. Although the system of the present invention has been disclosed with reference to a fuel delivery system, particularly a gasoline delivery system, the nozzle assembly of the present invention can be used to prevent escape of vapors in systems for the delivery of liquids other than fuels. Accordingly, it is seen that in accordance with the present invention a nozzle assembly is provided for the delivery of liquids and including means for substantially preventing escape to the atmosphere of vapor during such delivery.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A liquid dispensing nozzle assembly for delivery of liquid from a liquid source to a liquid receiver having a receiver inlet, said assembly being provided with means to allow for the removal of vapor during delivery of liquid to said receiver inlet from said source, said nozzle assembly comprising:

1. a liquid dispensing nozzle having a nozzle inlet, a nozzle housing and an elongated discharge spout adapted for insertion into said receiver inlet;
2. a vapor collector surrounding, in spaced relation thereto and forming a chamber therearound, the upper portion of said spout nearest said nozzle housing, said chamber being in fluid communication with the receiver inlet when said nozzle is inserted into said liquid receiver, one end of said vapor collector being sealed to said nozzle housing, or in proximity thereto, a sealant means carried by the other end of said vapor collector and having an exposed face for forming a surface seal against the outer surface of said receiver inlet, said spout extending beyond the other end of said sealant means; and
3. means for allowing removal of vapor from said chamber; the improvement comprising said sealant means comprising a compressible cellular plastic material obtained from a fluorine-containing elastomer, said material having:
   a. a plurality of cells present as part of its structure;
   b. compressibility under normal nozzle loads of the material in contact with the outer surface of the receiver inlet in the range of from about 5 to about 85% of that part of the material's original preload volume;
   c. substantial resistance to the liquid dispensed and vapor being removed; and
   d. the ability to form a seal against the outer surface of said receiver inlet and reduce the amount of vapor escaping to the atmosphere during liquid dispensing when said spout is inserted into and said exposed face contacts the outer surface of said receiver inlet.

2. A liquid dispensing nozzle assembly of claim 1 wherein the compressible cellular plastic material is obtained from a polymer selected from the group consisting of fluorine containing elastomers which have at least 10 weight percent of fluorine.

3. A liquid dispensing nozzle assembly of claim 2 wherein the elastomer has at least 35 weight percent of fluorine.

4. A liquid dispensing nozzle assembly of claim 2 wherein the elastomer has at least 60 weight percent of fluorine.

5. A liquid dispensing nozzle assembly of claim 1 wherein said vapor collector comprises a flexible bellows.

6. A liquid dispensing nozzle assembly of claim 1 wherein said fluorine containing elastomer is derived from vinylidene fluoride.

7. a liquid dispensing nozzle assembly of claim 1 wherein the exposed face of the compressible cellular plastic material comprises an additional resilient material and the liquid is a fuel.

8. A liquid dispensing nozzle assembly of claim 2 wherein the exposed face of the compressible cellular plastic material comprises an additional resilient material and the liquid is a fuel.

9. A liquid dispensing nozzle assembly of claim 7 wherein said additional resilient material is selected from the group consisting of leather and polychloroprene.

10. A liquid dispensing nozzle assembly of claim 1 wherein the compressible cellular plastic material is predominantly closed-celled, and the liquid is a fuel.

11. A liquid dispensing nozzle assembly of claim 2 wherein said compressible cellular plastic material is predominantly closed-celled, and the liquid is a fuel.

12. A liquid dispensing nozzle assembly of claim 6 wherein said compressible cellular plastic material is predominantly closed-celled, and the liquid is a fuel.

13. A liquid dispensing nozzle assembly of claim 1 wherein said compressible cellular plastic material in contact with the outer surface of the receiver inlet is compressed under normal loads in the range from about 25 to about 75% based upon that part of the material's original preload volume.

* * * * *

Disclaimer 4,003,416.—*Bernard E. Weidenaar*, Hacienda Heights, Calif.; *Frederick L. Voelz*, Orland Park, and *James J. Simnick*, Riverdale, Ill.; and *Peter P. Moskovich, Jr.*, Gary, Ind. LIQUID-DISPENSING NOZZLE ASSEMBLY. Patent dated Jan. 18, 1977. Disclaimer filed Jan. 24, 1977, by the assignee, *Atlantic Richfield Company.*

The term of this patent subsequent to Nov. 23, 1993, has been disclaimed. [*Official Gazette March 29, 1977.*]